US009207588B2

(12) United States Patent
Nishida et al.

(10) Patent No.: US 9,207,588 B2
(45) Date of Patent: Dec. 8, 2015

(54) IMAGE FORMING APPARATUS HAVING FIRST AND SECOND INDEPENDENTLY CONTROLLABLE FANS

(71) Applicant: CANON KABUSHIKI KAISHA, Tokyo (JP)

(72) Inventors: Satoshi Nishida, Numazu (JP); Takanori Mitani, Tokyo (JP); Akimichi Suzuki, Yokohama (JP); Hideo Nanataki, Yokohama (JP); Shogo Kan, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/254,075

(22) Filed: Apr. 16, 2014

(65) Prior Publication Data

US 2014/0314437 A1 Oct. 23, 2014

(30) Foreign Application Priority Data

Apr. 19, 2013 (JP) ..... 2013-088172
Mar. 31, 2014 (JP) ..... 2014-072125

(51) Int. Cl.
*G03G 21/20* (2006.01)
*G03G 15/20* (2006.01)

(52) U.S. Cl.
CPC ..... *G03G 15/2017* (2013.01); *G03G 21/206* (2013.01); *G03G 2215/2035* (2013.01)

(58) Field of Classification Search
CPC ..... G03G 15/657; G03G 15/2028; G03G 15/2017; G03G 15/2085
See application file for complete search history.

(56) References Cited

U.S. PATENT DOCUMENTS

| | | | | |
|---|---|---|---|---|
| 4,720,727 | A * | 1/1988 | Yoshida | 399/93 |
| 7,162,194 | B2 | 1/2007 | Hotta et al. | |
| 7,203,438 | B2 | 4/2007 | Omata et al. | |
| 7,206,541 | B2 | 4/2007 | Fukita et al. | |
| 7,519,320 | B2 | 4/2009 | Aoki et al. | |
| 7,599,637 | B2 | 10/2009 | Nanataki et al. | |
| 7,650,105 | B2 | 1/2010 | Ogawa et al. | |
| 7,702,249 | B2 | 4/2010 | Nishida | |
| 7,734,241 | B2 | 6/2010 | Nishida et al. | |
| 7,787,792 | B2 | 8/2010 | Nishida | |
| 7,865,102 | B2 | 1/2011 | Nanataki et al. | |
| 8,229,338 | B2 | 7/2012 | Nanataki et al. | |
| 8,285,183 | B2 | 10/2012 | Nishida et al. | |

(Continued)

FOREIGN PATENT DOCUMENTS

| | | | |
|---|---|---|---|
| JP | 7-160178 | A | 6/1995 |
| JP | 2008281879 | A * | 11/2008 |
| JP | 2009069277 | A * | 4/2009 |

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus includes: an image forming portion; a fixing portion; a first air blowing portion; and a second air blowing portion. The apparatus is operable in a first air blowing mode in which both the first and second air blowing portions are driven and in which the direction of the air near the exit is the recording material feeding direction, and is operable in a second air blowing mode in which both the first and second air blowing portions are driven and in which a direction of the air near the exit is a recording material feeding direction and a speed of the air is lower than a speed of the air in the first air blowing mode or in which the direction of the air near the exit is the opposite direction to the recording material feeding direction.

5 Claims, 4 Drawing Sheets

(56) References Cited

U.S. PATENT DOCUMENTS

| | | | | |
|---|---|---|---|---|
| 8,483,603 | B2 | 7/2013 | Nihonyanagi et al. | |
| 8,532,530 | B2 | 9/2013 | Nishida et al. | |
| 2005/0105929 | A1* | 5/2005 | Chae et al. | 399/69 |
| 2008/0181688 | A1* | 7/2008 | Kurita | 399/341 |
| 2011/0052246 | A1* | 3/2011 | Kyung et al. | 399/92 |
| 2011/0243620 | A1 | 10/2011 | Mitsuhashi et al. | |
| 2012/0155938 | A1 | 6/2012 | Tanaka et al. | |
| 2012/0243894 | A1 | 9/2012 | Umeda et al. | |
| 2012/0328341 | A1 | 12/2012 | Okayasu et al. | |
| 2014/0023413 | A1 | 1/2014 | Shinji et al. | |

* cited by examiner

IMAGE FORMING APPARATUS HAVING FIRST AND SECOND INDEPENDENTLY CONTROLLABLE FANS

FIELD OF THE INVENTION AND RELATED ART

The present invention relates to an image forming apparatus such as an electrophotographic copying machine or an electrophotographic printer.

In a conventional image forming apparatus using an electrophotographic process, a toner image formed on a photosensitive drum is, after being transferred onto a recording material, fixed on the recording material by being passed through a fixing device as an image heating apparatus. Incidentally, as the image heating apparatus, other than a fixing device for heat-fixing the toner image, as a fixed image, on the recording material, it is possible to use, e.g., a glossiness increasing device for increasing a glossiness of an image by heating the image fixed on the recording material.

In many image forming apparatuses, a cooling fan (air blowing means) is provided as an air blowing unit for dissipating, into an outside of an apparatus main assembly, heat generated inside the apparatus main assembly during an image forming operation, particularly heat generated from the fixing device as the image heating apparatus, whereby a temperature rise at the inside of the apparatus main assembly is prevented.

Then, ordinarily, a cool operation by the cooling fan is started during actuation of the image forming apparatus or simultaneously with start of the image forming operation, but Japanese Laid-Open Patent Application (JP-A) Hei 7-160178 discloses that the cooling fan is not actuated until an ambient temperature in the neighborhood of the fixing device increases up to a temperature enough to fix an image. That is, for the purpose of reducing power consumption and improving an image fixing property, an inside temperature of the fixing device is detected and an operation of the cooling fan is controlled. Incidentally, in the fixing device as the image heating apparatus, a toner image is fixed on the recording material by heating the toner, but depending on an influence of heat during thus heating, particles of 0.1 μm or less in small particle diameter (hereinafter referred to as small diameter particles) are generated. As in a constitution of JP-A Hei 7-160178, cool of the inside of the fixing device cannot be effected during a period in which the cooling fan is not actuated.

SUMMARY OF THE INVENTION

A principal object of the present invention is to provide an image forming apparatus, including a plurality of air blowing portions, capable of compatibly realizing suppression of an amount of small diameter particles developed to an outside of the image forming apparatus and cool of the image forming apparatus by control of the air blowing portions.

According to an aspect of the present invention, there is provided an image forming apparatus comprising: an image forming portion for forming a toner image on a recording material; a fixing portion for fixing the toner image on the recording material by heating the recording material while feeding the recording material, through a nip, on which the toner image is formed; a first air blowing portion for blowing air so that a direction of the air in the neighborhood of an exit of the nip is a recording material feeding direction; and a second air blowing portion for blowing the air so that the direction of the air in the neighborhood of the exit is an opposite direction to the recording material feeding direction, wherein the image forming apparatus is capable of executing an operation in a first air blowing mode in which both the first and second air blowing portions are driven and in which the direction of the air in the neighborhood of the exit is the recording material feeding direction, and is capable of executing an operation in a second air blowing mode in which both the first and second air blowing portions are driven and in which the direction of the air in the neighborhood of the exit is the recording material feeding direction and a speed of the air is lower than a speed of the air in the operation in the first air blowing mode or in which the direction of the air in the neighborhood of the exit is the opposite direction to the recording material feeding direction.

According to another aspect of the present invention, there is provided an image forming apparatus comprising: an image forming portion for forming a toner image on a recording material; a fixing portion for fixing the toner image on the recording material by heating the recording material while feeding the recording material, through a nip, on which the toner image is formed; a first air blowing portion for blowing air so that a direction of the air in the neighborhood of an exit of the nip is a recording material feeding direction; and a second air blowing portion for blowing the air so that the direction of the air in the neighborhood of the exit is an opposite direction to the recording material feeding direction, wherein the image forming apparatus is capable of executing an operation in a first air blowing mode in which both the first and second air blowing portions are driven and is capable of executing an operation in a second air blowing mode in which both the first and second air blowing portions are driven and in which a speed of the air in the neighborhood of the exit is lower than a speed of the air in the operation in the first air blowing mode.

According to another aspect of the present invention, there is provided an image forming apparatus comprising: an image forming portion for forming a toner image on a recording material; a fixing portion for fixing the toner image on the recording material by heating the recording material while feeding the recording material, through a nip, on which the toner image is formed; a first air blowing portion for blowing air so that a direction of the air in the neighborhood of an exit of the nip is a recording material feeding direction; and a second air blowing portion for blowing the air so that the direction of the air in the neighborhood of the exit is an opposite direction to the recording material feeding direction, wherein the image forming apparatus is capable of executing an operation in a first air blowing mode in which the first air blowing portion is driven and the second air blowing portion is not driven, and is capable of executing an operation in a second air blowing mode in which the first air blowing portion is not driven and the second air blowing portion is driven.

According to a further aspect of the present invention, there is provided an image forming apparatus comprising: an image forming portion for forming a toner image on a recording material; a fixing portion for fixing the toner image on the recording material by heating the recording material while feeding the recording material, through a nip, on which the toner image is formed; and an air blowing portion for blowing air so that a direction of the air in the neighborhood of an exit of the nip is an opposite direction of a recording material feeding direction.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described with reference to the drawings.

First Embodiment (Image Forming Apparatus)

Figure 2:
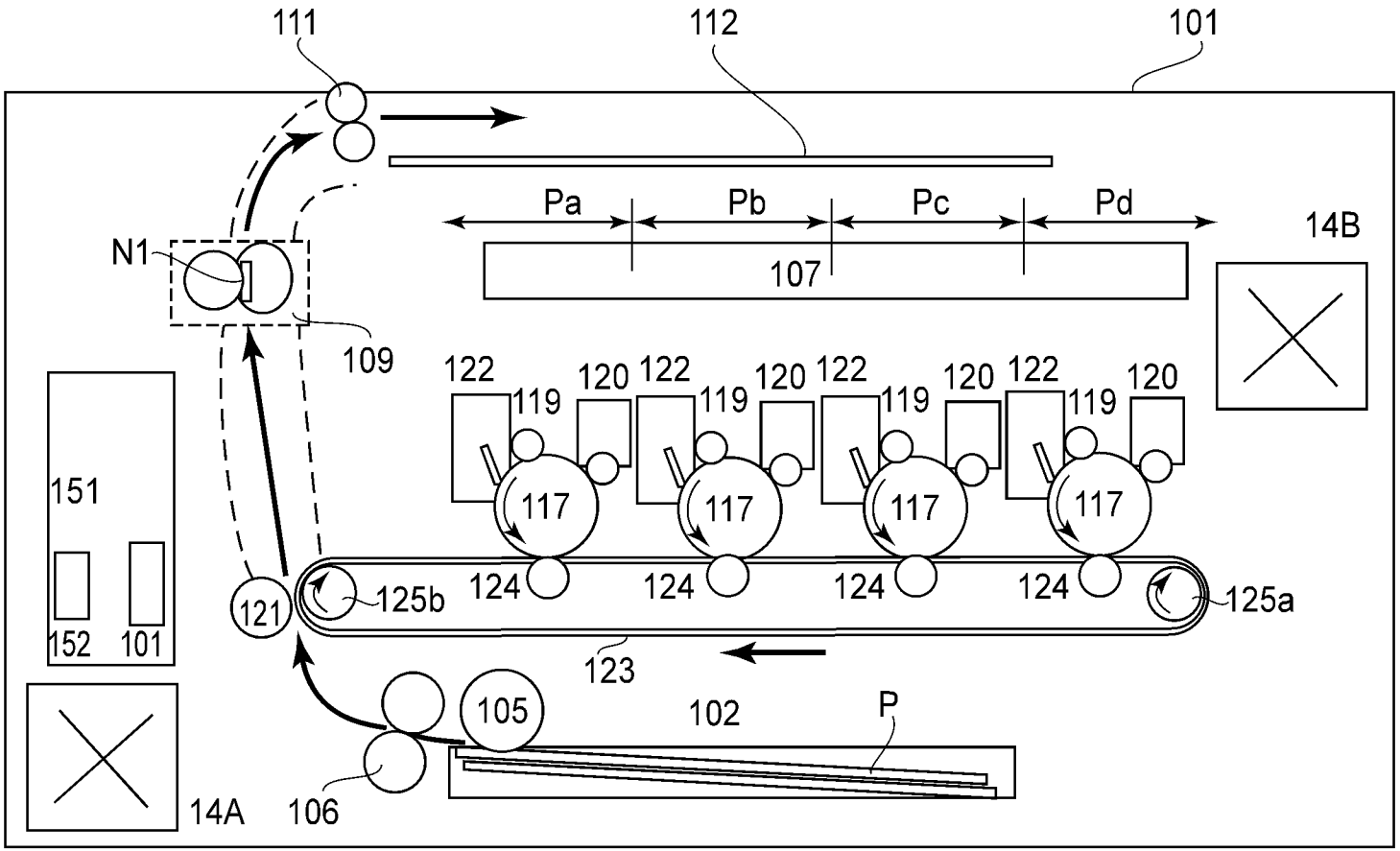
FIG. 2 is a schematic sectional view showing a cross-sectional side surface of the image forming apparatus in First Embodiment.

FIG. 2 is a schematic view showing a cross-sectional side surface of an image forming apparatus in this embodiment in which a fixing device as an image heating apparatus is mounted. This image forming apparatus is a laser beam printer of an electrophotographic type and is capable of outputting a full-cover print of 150 mm/sec in process speed and 28 sheets/min in output rate. The image forming apparatus in this embodiment is of an in-line type in which first to fourth image forming portions Pa, Pb, Pc and Pd for forming toner images of cyan, magenta, yellow and black, respectively, by using associated toners as developers are juxtaposed in line in a predetermined.

Each of the image forming portions Pa, Pb, Pc and Pd includes a drum-shaped electrophotographic photosensitive member (photosensitive drum) 117 as an image bearing member. In each of the image forming portions Pa, Pb, Pc and Pd, at a periphery of an outer peripheral surface of the photosensitive drum 117, a drum charger 119 as a charging member and a scanning exposure device 107 as an exposure means are provided. Further, at the periphery of the surface of the photosensitive drum 117, a developing device 120 as a developing means and a drum cleaner 122 are provided.

Further, an intermediary transfer belt 123 as a conveying member is provided so as to extend over the photosensitive drums 117 of the image forming portions Pa, Pb, Pc and Pd. This intermediary transfer belt 123 is extended around a driving roller 125*a* and a secondary transfer opposite roller 125*b*. On an image peripheral surface side of the intermediary transfer belt 123, primary transfer rollers 124 as a first transfer member are provided so as to sandwich the intermediary transfer belt 123 between the primary transfer rollers 124 and the photosensitive drums 117. On an outer peripheral surface side of the intermediary transfer belt 123, a secondary transfer roller 121 as a second transfer member is provided so as to sandwich the intermediary transfer belt 123 belt the secondary transfer roller 121 and the secondary transfer opposite roller 125*b*.

In the image forming apparatus in this embodiment, a controller 101 executes a predetermined image forming sequence depending on a print instruction (command) outputted from an external device (not shown) such as a host computer, a terminal on a network or an external scanner. The controller 101 includes CPU and memories such as ROM and RAM, and in the memories, various programs necessary to the image forming sequence and image formation are stored.

(Image Forming Operation)

An image forming operation of the image forming apparatus in this embodiment will be described with reference to FIG. 2. The controller 101 successively drives the image forming portions Pa, Pb, Pc and Pd in accordance with the image forming sequence executed depending on the print instruction. First, the photosensitive drums 117 are rotated in arrow directions at a predetermined peripheral speed (process speed), an at the same time, the intermediary transfer belt 123 is rotated by the driving roller 125*a* in an arrow direction at a peripheral speed corresponding to the rotational peripheral speed of the photosensitive drums 117.

In the image forming portion Pa for cyan as a first color, the surface of the photosensitive drum 117 is electrically charged uniformly to a predetermined polarity and a predetermined potential by the drum charger 119. Then, the charged surface of the photosensitive drum 117 is subjected to scanning exposure, by the scanning exposure device 107, to laser light depending on image data (image information) outputted from the external device. As a result, an electrostatic latent image (electrostatic image) depending on the image data is formed on the charged surface of the photosensitive drum 117. Then, the electrostatic latent image is developed with the cyan toner by the developing device 120. As a result, a cyan toner image (developer image) is formed on the surface of the photosensitive drum 117.

Similar steps of charging, exposure and development are performed also in the image forming portion Pb for magenta as a second color, the image forming portion Pc for cyan as a third color and the image forming portion Pd for black as a fourth color. The respective color toner images formed on the surfaces of the respective photosensitive drums 117 are successively transferred superposedly onto the surface of the intermediary transfer belt 123 by the primary transfer rollers 117 at primary transfer nips each between the surface of the photosensitive drum 117 and the surface of the intermediary transfer belt 123. As a result, a full-color toner image is carried on the surface of the intermediary transfer roller 123.

The surface of the photosensitive drum 117 after the toner image transfer is subjected to subsequent image formation by removing transfer residual toner, remaining on the surface of the photosensitive drum 117, by the drum cleaner 122.

On the other hand, sheets of a recording material P such as recording paper are fed one by one from a feeding cassette 102 by a feeding roller 105, and the recording material P is fed to a registration roller pair 106. This recording material P is fed, by the registration roller pair 106, to a secondary transfer nip between the surface of the intermediary transfer roller 123 and an outer peripheral surface of the secondary transfer roller 121. Further, in this feeding process, the toner images on the surface of the intermediary transfer belt 123 are transferred into the recording material P by the secondary transfer roller 121. As a result, the full-color toner image is carried on the recording material P.

The recording material P carrying thereon the full-color image is introduced into a fixing nip N1 of the fixing device 109 in a fixing portion described specifically below. Further, at the fixing nip N1, the recording material P is nipped and fed, so that heat and nip pressure are applied to the toner image. As a result, the toner image on the recording material P is heat-fixed on the recording material P. The recording material P coming out of the fixing nip N1 is discharged onto a sheet-discharge tray 112 by a roller pair provided at a sheet-discharging portion 111.

(Image Heating Apparatus)

Figure 3:
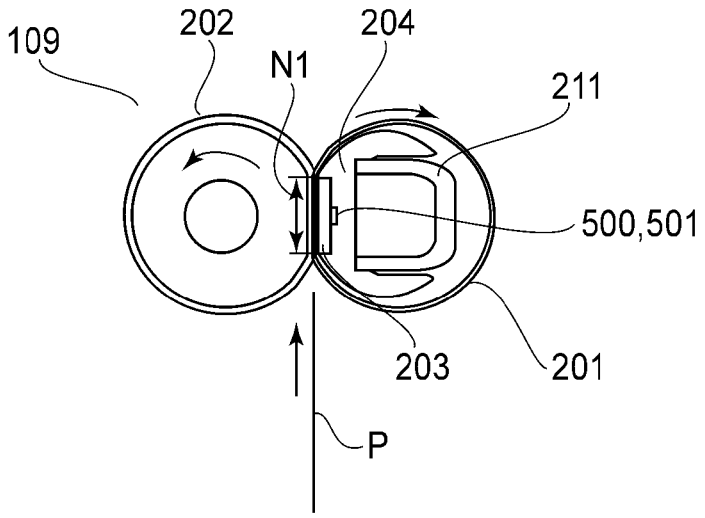
FIG. 3 is a schematic sectional view showing a fixing device in the image forming apparatus in First Embodiment.

Then, with reference to FIG. 3, the fixing device 109 as an image heating apparatus and its constituent members will be described. In FIG. 3, the fixing device 109 includes a fixing film 201 as a heating member, a pressing roller 202 as a pressing member, and a ceramic heater 203 functioning as both the heating member and a slidable member. The ceramic heater 203 is supported by a heater holder 204 as a supporting member and is pressed by an unshown pressing mechanism via a metal stay 211 for imparting rigidity.

The fixing film 201 is prepared by providing a rubber layer of an elastic member such as a silicone rubber on a thin base layer of a resin such as polyimide or metal such as SUS or nickel and then by providing, at an outermost surface, a surface layer of a fluorine-containing resin or the like excellent in parting property. The thermal capacity of the fixing film 201 is very small compared with a conventional heating roller, and therefore it becomes possible to increase a temperature at the nip in a very short time by supplying electric power to the heater 203. As a result, it becomes possible to obtain a fixed image quickly as needed with no wait time. In a recording material passing region of the heater 203, a main thermistor 500 as a first temperature detecting member is provided. Depending on a detection temperature of the main thermistor 500, the heater 203 is controlled. The main thermistor 500 may also be a member for detecting a temperature of the fixing film 201. In a recording material non-passing region of the heater 203, a sub-thermistor 501 as a second temperature detecting member is provided. The sub-thermistor 501 monitors temperature rise inconvenience in the non-passing-portion.

The pressing roller 202 is obtained by providing, on a core metal of iron or aluminum, an elastic layer of a silicone rubber, a silicone sponge or the like and then by providing, a surface of the elastic layer, a parting layer of a fluorine-containing resin or the like.

The ceramic heater 203 is prepared by forming, on a substrate of ceramic such as alumina or aluminum nitride, a heat generating resistor of silver-palladium alloy or the like by screen printing and then by connecting an electrode of silver or the like with the heat generating resistor. On the heat generating resistor, gloss coating is made to protect the heat generating resistor, so that a sliding property with the fixing film 201 is ensured. The heater holder 204 is obtained by molding a high heat-resistant resin material such as PPS (polyphenylene sulfide) or a LCP (liquid crystal polymer). The heater holder 204 also functions as a guide for rotating the fixing film 201 while holding the heater 203 and keeping a proper shape of the fixing film 201.

(Image Heating Operation)

Then, an image heating operation in the fixing device 109 as the image heating apparatus will be described. The heater 203 held by the heater holder 204 is press-contacted to the fixing film 201 toward the pressing roller 202 to form the fixing nip N1. The pressing roller 202 is rotationally driven, s that the fixing film 201 is provided with a rotational force by the pressing roller 202 and thus is rotated by the pressing roller 202 while sliding with the heater 203. At this time, electric power is supplied to the heater 203 from an unshown electric power source circuit to cause the heat generating resistor to generate heat, so that the heat is supplied to the fixing nip N1.

Then, the recording material P on which the toner image is transferred is conveyed and fed to the fixing nip N1, and then heat and pressure are applied to the toner image, so that the toner image is fixed as an image on the recording material P.

(Air Blowing Unit)

The air blowing unit in this embodiment will be described with reference to the drawings. This air blowing unit includes two cooling fans different in object to be cooled, but as the sum of the two cooling fans, heat of the recording material P in a downstream side of at least the fixing device with respect to a recording material feeding direction is cooled by air blowing.

Figure 1:
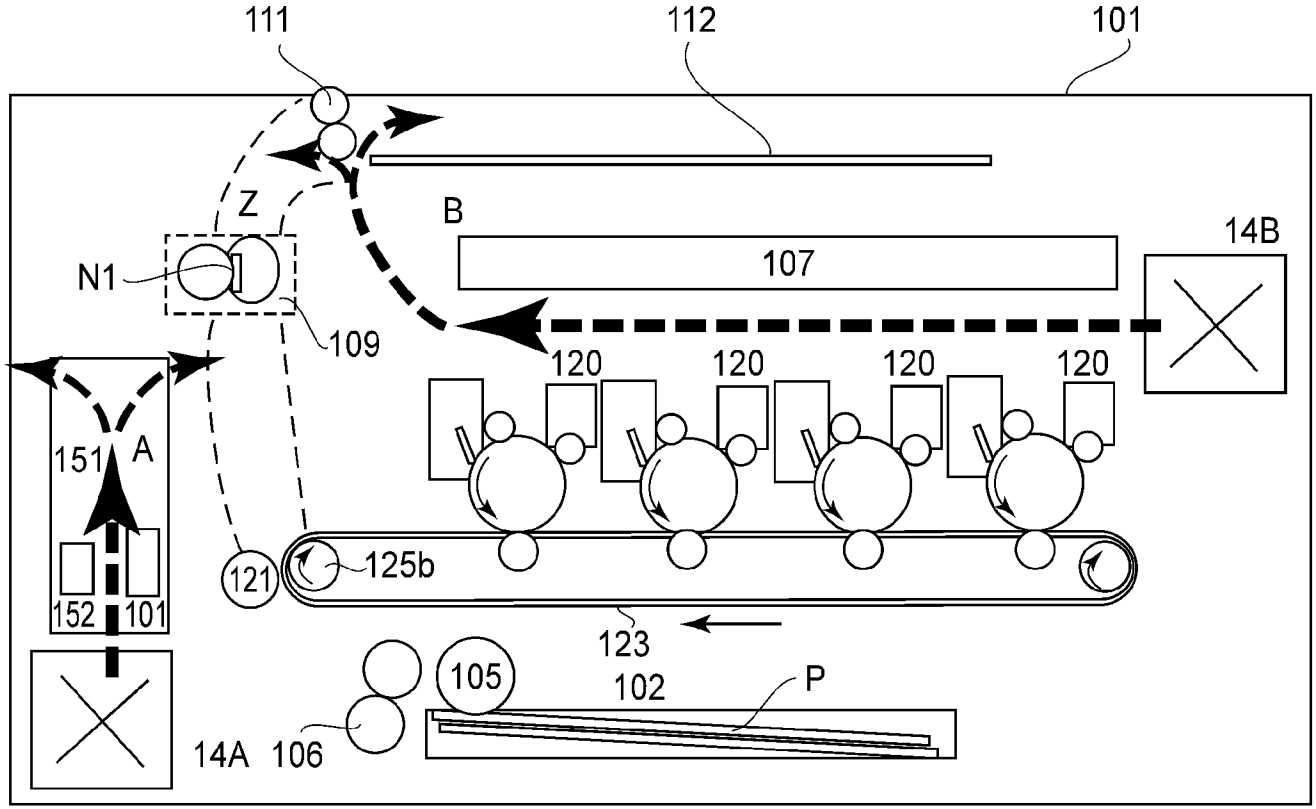
FIG. 1 is a schematic sectional view showing a cooling fan and a flow path (airflow path) of an image forming apparatus according to First Embodiment of the present invention.

With reference to FIG. 1, the cooling fans and flow paths (air paths) will be described. At a lower portion of a side surface of the image forming apparatus, a cooling fan 14A (first air blowing portion) as a cool portion for exhausting heat of a power source portion 151 is provided, and an air path is formed along an arrow A direction. The cooling fan 14A is, e.g., a DC fan motor of 80 mm×80 mm in dimension, 15 mm in depth, 0.58 ($m^3$/min) in maximum airflow rate and 22.6 (Pa) in maximum static pressure. The air sucked from the cooling fan 14A passes through the power source portion 151 and partly flows into an upstream side of the fixing device 109 with respect to the recording material feeding direction.

Further, at an upper portion of a side surface of the image forming apparatus, a cooling fan 14B (second air blowing portion) as a cool portion for cooling the developing devices 120 and the discharged recording material P is provided, and a flow path (air path) is formed along an arrow B direction. Also the cooling fan 14B is, similarly as in the case of the cooling fan 14A, e.g., a DC fan motor of 80 mm×80 mm in dimension, 15 mm in depth, 0.58 ($m^3$/min) in maximum airflow rate and 22.6 (Pa) in maximum static pressure. The air sucked from the cooling fan 14B passes through a region in the neighborhood of the developing devices 120 and is exhausted from an exhaust portion 111 provided in a downstream side of the fixing device 109 with respect to the recording material feeding direction.

The cooling fans 14A and 14B are independently driven by a driving circuit portion 152 of the controller 101, and are independently controlled with respect to the number of rotation, so that the airflow rate of the air sent to the inside of the image forming apparatus by each of the cooling fans 14A and 14B can be changed.

Incidentally, in this embodiment, each of a first air blowing portion and a second air blowing portion is constituted by a single cooling fan but may also be constituted by two or more cooling fans.

(Influence of Air Blowing Unit on Periphery of Fixing Device)

Figure 4:
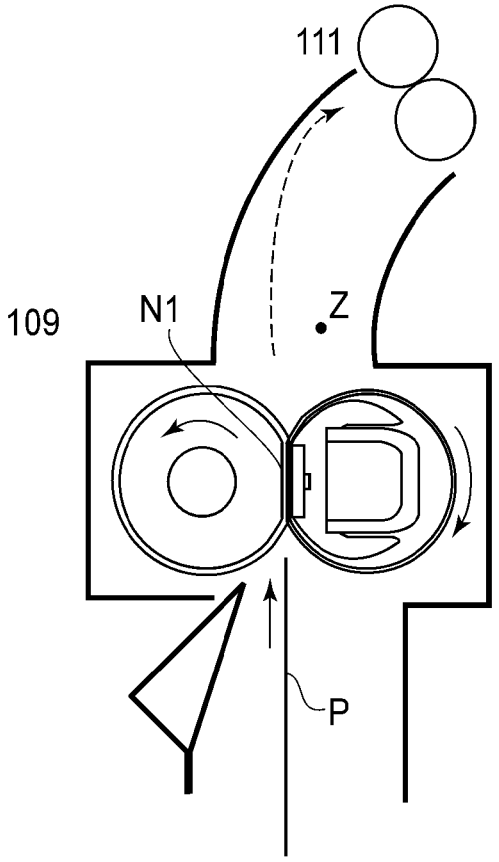
FIG. 4 is a schematic sectional view showing the fixing device and its peripheral portion in the image forming apparatus in First Embodiment.

A check result of the influence, on a peripheral airflow of the fixing device 109, of air blowing from the cooling fans 14A and 14B constituting the air blowing unit. FIG. 4 is a schematic sectional view at a peripheral portion of the fixing device 109. At a measurement point Z in the downstream side of the fixing device 109 with respect to the recording material feeding direction, an airflow direction was checked by a flow marker (manufactured by Accusense), and an air speed (wind speed) was measured by an airflow sensor ("ATM2400", manufactured by Accusense). A direction of the air flowing from the fixing device 109 into the sheet-discharging portion 111 is defined as a positive direction, and an opposite direction of the air flowing from the sheet-discharging portion 111 into the fixing device 109 is defined as a negative direction.

In this way, the measurement of the airflow is made between the fixing device 109 and a largest opening directed from the fixing device 109 to the outside of the image forming apparatus, and a point which is located between the fixing device 109 and the sheet-discharging portion 111 and which is disposed in a recording material feeding path and in the neighborhood of an exit of the nip of the fixing device 109 was taken as the measurement point Z. Incidentally, the measurement of the air speed of the airflow may desirably be made in the neighborhood of the fixing device, but in the case where the airflow locally causes a swirl (eddy), the air speed may also be measured in a further downstream side with respect to the recording material feeding direction. Further, in the case where the airflow swirls or is locally unstable, movement of a visualized airflow itself may also be recorded in image, and an air movement speed as a whole may be taken as the air speed.

The influence of such air blowing from the cooling fans 14A and 14B on the airflow at the periphery of the fixing device 109 was checked by effecting the measurement in a state in which the image forming apparatus effects the image formation and the fixing device 109 performs the heat-fixing operation while feeding the recording material P. The air speeds at the measurement point Z when the cooling fans 14A and 14B are operated are shown in Table 1.

TABLE 1

| Operated cooling fan | Air speed (m/s) |
|---|---|
| 14A only | +0.70 |
| 14B only | −0.08 |
| Both 14A and 14B | +0.35 |

The cooling fan 14A generated the airflow, at the measurement point Z, flowing in the positive direction (recording material feeding direction) from the fixing device 109 toward the sheet-discharging portion 111. On the other hand, the cooling fan 14B generated airflow, at the measurement point Z, flowing in the negative direction (opposite direction to the recording material feeding direction) from the sheet-discharging portion 111 toward the fixing device 109. In the case where both the cooling fans 14A and 14B are actuated, the airflow was directed in the positive direction.

Here, each of the cooling fans 14A and 14B in this embodiment is independently controlled with respect to the number of rotation, so that the amount of the air sent in the image forming apparatus by the cooling fan can be changed. A result of measurement of the speed of airflow at the measurement point Z in the case where an output of the cooling fan 14A is changed from 100% to 0% relative to a maximum output is shown in Table 2.

TABLE 2

| Fan 14A Output | Fan 14B Output | Air speed (m/s) |
|---|---|---|
| 100% | 100% | +0.35 |
| 80% | 100% | +0.26 |
| 60% | 100% | +0.17 |
| 40% | 100% | +0.08 |
| 20% | 100% | +0.00 |
| 0% | 100% | −0.08 |

With a smaller output of the cooling fan 14A, the speed of the airflow from the fixing device 109 toward the sheet-discharging portion 111 at the measurement point Z was decreased. Further, when the output of the cooling fan 14A was 20% or less, the direction of the airflow at the measurement point Z was reversed, so that the air flowed from the sheet-discharging portion 111 toward the fixing device 109.

Next, a result of measurement of the speed of airflow at the measurement point Z in the case where an output of the cooling fan 14B is changed from 100% to 0% relative to a maximum output is shown in Table 3.

TABLE 3

| Fan 14A Output | Fan 14B Output | Air speed (m/s) |
|---|---|---|
| 100% | 100% | +0.35 |
| 100% | 80% | +0.42 |
| 100% | 60% | +0.49 |
| 100% | 40% | +0.56 |
| 100% | 20% | +0.63 |
| 100% | 0% | −0.70 |

With a smaller output of the cooling fan 14B, the speed of the airflow from the fixing device 109 toward the sheet-discharging portion 111 at the measurement point Z was increased.

Further, a result of measurement of the speed of airflow at the measurement point Z in the case where both outputs of the cooling fans 14A and 14B are changed from 100% to 0% is shown in Table 4.

TABLE 4

| Fan 14A Output | Fan 14B Output | Air speed (m/s) |
|---|---|---|
| 100% | 100% | +0.35 |
| 80% | 80% | +0.35 |
| 60% | 60% | +0.35 |
| 40% | 40% | +0.35 |
| 20% | 20% | +0.36 |
| 0% | 0% | +0.36 |

When both the outputs of the cooling fan 14A and 14B were changed, the speed of the airflow of the measurement point Z was not substantially changed.

(Air Blowing Operation Mode of Air Blowing Unit)

An air blowing mode of the cooling fan in the air blowing unit in this embodiment will be described. The air blowing unit in this embodiment is operable in at least two cooling fan operation modes. That is, the air blowing unit is operable in a normal mode (first air blowing mode) in which cooling of the image forming apparatus is a high priority and a discharge amount (second air blowing unit) in which a discharge amount of particles of 0.1 μm or less (small diameter particles) from the image forming apparatus can be suppressed. In the discharge amount suppressing mode, the speed of the airflow directed toward a side (sheet-discharging portion 111) downstream of the fixing device 109 with respect to the recording material feeding direction is slower than the speed of the airflow in the normal mode.

In the normal mode, the cooling in the image forming apparatus is the high priority and the cooling fans 14A and 14B are operated at a maximum output. On the other hand, in the discharge amount suppressing mode, the output (the number of rotation) of at least one of the cooling fans 14A and 14B is controlled to decrease the speed of the airflow directed in the positive direction from the fixing device 109 toward the sheet-discharging portion 111. Incidentally, there is also the airflow directed in the negative direction from the sheet-discharging portion 111 toward the fixing device 109.

In the discharge amount suppressing mode, in order to stagnate the small diameter particles in the image forming apparatus, irrespective of the direction of the airflow, the speed of the airflow between the fixing device 109 and the sheet-discharging portion 111 may preferably be made lower than the airflow speed in the normal mode.

In the discharge amount suppressing mode in this embodiment, the output of the cooling fan 14A is, e.g., 20% while maintaining the output of the cooling fan 14B at 100%. An output value of the cooling fans 14A and 14B may also be a combination of other output values. That is, the output value may only be required so that the speed of the airflow directed from the fixing device 109 toward the sheet-discharging portion 111 in the discharge amount suppressing mode can be made lower than the airflow speed in the normal mode in which both the cooling fans 14A and 14B are operated at the maximum output.

(Suppression of Discharge Amount of Small Diameter Particles)

Suppression of the discharge amount of the small diameter particles from the image forming apparatus in the discharge amount suppressing mode was checked in the following experiments. The image forming apparatus used in the experiments is a lower beam printer (capable of outputting a full-color print at a rate of 28 sheets/min and at a process speed of 150 mm/sec) in this embodiment. Each of the experiments was conducted by using such an image forming apparatus in this embodiment and included three cases including a first case where the image forming apparatus is operated in the discharge amount suppressing mode, a second case where the image forming apparatus is operated in the normal mode and a third case where the cooling fans are at rest as a comparison example.

In the discharge amount suppressing mode, the cooling fan 14A was operated at the output of 20%, and cooling fan 14B was operated at the output of 100%. In the normal mode, both the cooling fans 14A and 14B were operated at the output of 100%. Further, in the comparison example, both the cooling fans 14A and 14B were turned off.

(Experiment 1)

In Experiment 1, the experiment was started from a cold state of the image forming apparatus in an environment of a temperature of 23° C. and a humidity of 50% RH (cold start). The image forming apparatus was left standing for 3 hours in the environment, and at the time of the start, an ambient temperature at the measurement point Z in the downstream side in the image forming apparatus with respect to the recording material feeding direction was 23° C.

An evaluation method is as follows. An inside of a hermetically sealed chamber of 3 $m^3$ in volume was filled with air, and then the image forming apparatus was disposed in the chamber and was subjected to measurement of a discharge amount per unit volume of the small diameter particles after a continuous print was effected for 10 min. The measurement of the discharge amount of the small diameter particles was made by using a nanoparticle diameter distribution measuring device ("FMPS 3091", manufactured by TSI). The printing was made by using ordinary LBP printing paper (basis weight: 80 g/$m^2$, A4 size (210 mm×297 mm)), and a character image of 5% in print ratio was printed. Table 5 shows a ratio of the discharge amount (particles/$m^3$) of the small diameter particles in each of the normal mode and the discharge amount suppressing mode in this embodiment when the discharge amount of the small diameter particles in the image forming apparatus in the comparison example is taken as 1.

TABLE 5

| | 14A | 14B | Speed (m/s)*4 | Ratio* |
|---|---|---|---|---|
| DASM*1 | 20% | 100% | 0.00 | 0.26 |
| NM*2 | 100% | 100% | +0.35 | 0.93 |
| CE*3 | 0% | 0% | +0.36 | 1.00 |

*1"DASM" is the discharge amount suppressing mode.

*2"NM" is the normal mode.

*3"CE" is the comparison example.

*4"Speed" is the speed at the measurement point Z.

*5: "Ratio" is the ratio of the discharge amount of the small diameter particles in the associated mode to the discharge amount of the small diameter particles in the comparison example (ratio: 1.00).

As shown in Table 5, during execution of the operation in the discharge amount suppressing mode, in the downstream side of the fixing device with respect to the recording material feeding direction, there was substantially no airflow. The discharge amount of the small diameter particles from the image forming apparatus during execution of the operation in the discharge amount suppressing mode is smaller than the discharge amount of the small diameter particles from the image forming apparatus in the operation in the normal mode and the discharge amount of the small diameter particles from the image forming apparatus in the operation in the comparison example.

In the image forming apparatus during execution of the operation in the discharge amount suppressing mode, the output of the cooling fan 14A is lowered to 20%, and the cooling fan 14B is driven at the maximum output, so that the speed of the airflow directed from the fixing device 109 toward the outside of the image forming apparatus is made slower than the airflow speed in the operation in the normal mode. On the other hand, in the image forming apparatus during execution of the operation in the normal mode, each of the cooling fans 14A and 14B is continuously driven at the maximum output, and therefore the speed of the airflow directed from the fixing device 109 toward the outside of the image forming apparatus is higher than the airflow speed in the operation in the discharge amount suppressing mode.

Further, also in the comparison example, the speed of the airflow directed from the fixing device 109 toward the outside of the image forming apparatus is large. That is, upward airflow due to heat of the fixing device 109 and laminar airflow with feeding of the recording material P are generated, and therefore the airflow directed from the fixing device 109 toward the outside of the image forming apparatus cannot be suppressed only by simply stopping each of the cooling fans. In this way, the comparison example contributes to energy saving and noise reduction, but has a small effect of reducing the discharge amount of the small diameter particles.

As described above, in order to suppress the discharge amount of the small diameter particles from the image forming apparatus, as in the operation in the discharge amount suppressing mode in this embodiment, there is a need to control the number of rotation of each of the cooling fans so that the speed of the airflow directed from the fixing device 109 toward the outside of the image forming apparatus is lowered.

(Suppressing Mechanism of Discharge Amount of Small Diameter Particles)

It would be considered that the small diameter particles are generated by decomposition of the toner on the recording material P, grease or the like in the fixing device 109 due to heat of the fixing device 109. Further, it is understood that the small diameter particles generated by the decomposition are bonded to each other when contacted at a high temperature, and are agglomerated as large diameter particles.

Figure 5:
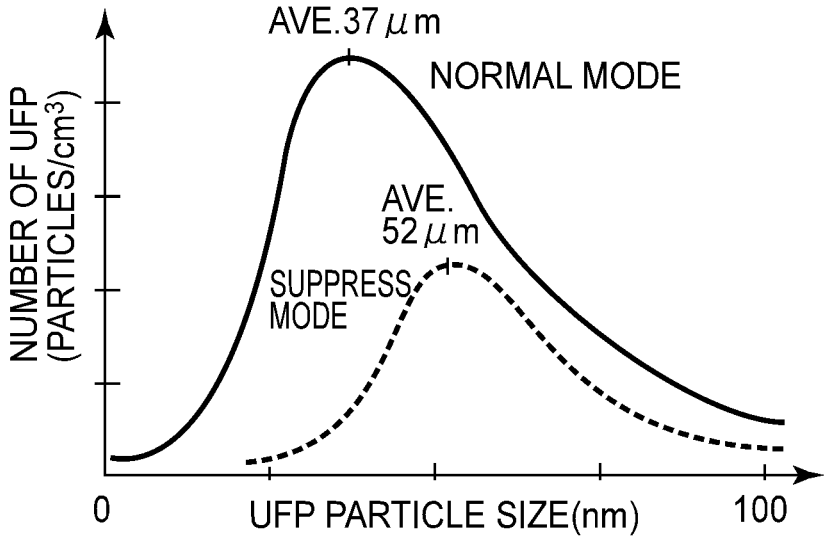
FIG. 5 is a graph showing a measurement result of a particle size distribution of small diameter particles in First Embodiment.

A particle size distribution of the small diameter particles generated in each of the case where the printing by the image forming apparatus is made in the discharge amount suppressing mode and the case where the printing by the image forming apparatus is made in the normal mode is shown in FIG. 5. In FIG. 5, an abscissa represents a particle size of the small diameter particles (ultrafine particles (UFP)), and an ordinate represents the discharge amount per unit volume of the small diameter particles. The small diameter particles generated in the discharge amount suppressing mode have a broader particle size distribution than the small diameter particles generated in the normal mode. The fixing device 109 is operated under the same condition, and therefore the particle size distribution and the number of generation of the small diameter particles generated in the fixing device 109 should be the same in the both modes. In the discharge amount suppressing mode, in a process of the discharge of the small diameter particles from the fixing device 109 toward the outside of the image forming apparatus, it is understood that the small diameter particles are bonded to each other to form large diameter particles and thus the discharge amount thereof is decreased.

On the other hand, by the influence the laminar airflow generated with movement of the recording material P, the upward airflow generated due to the heat of the fixing device 109, and the cooling fan, the airflow directed from the fixing device 109 toward the sheet-discharging portion 111 is generated. Then, the small diameter particles generated in the fixing device 109 are discharged to the outside of the image forming apparatus. The small diameter particles are quickly cooled or diffused by contact with the outside air, so that the bonding between the small diameter particles is not so generated.

In the discharge amount suppressing mode, the speed of the airflow directed from the fixing device 109 toward the sheet-discharging portion 111 is made low, so that the small diameter particles can be left for a long time in a narrow space between the fixing nip N1 of the fixing device 109 and the sheet-discharging portion 111. This space is warmed by the heat from the fixing device 109, and it would be considered that the small diameter particles are bonded to each other in the space and are formed in the large diameter particles. Further, the small diameter particles in a bondable state are also liable to be deposited on a peripheral member. The small diameter particles generated in the fixing device 109 are deposited on the peripheral member during movement toward the sheet-discharging portion 111, thus being less discharged from the image forming apparatus.

(Experiment 2)

Next, in Experiment 2, the experiment was started from a warmed state of the image forming apparatus in the environment of the temperature of 23° C. and the humidity of 50% RH (hot start). Specifically, this experiment was conducted after the continuous printing for 10 minutes was effected from the cold start. During start of the experiment, the temperature at the measurement point Z of the airflow speed in the downstream side of the image forming apparatus with respect to the recording material feeding direction was 63° C. An experimental result thereof is shown in Table 6.

TABLE 6

| | 14A | 14B | Speed (m/s)*4 | Ratio* |
|---|---|---|---|---|
| DASM*1 | 20% | 100% | +0.08 | 0.33 |
| NM*2 | 100% | 100% | +0.41 | 0.92 |
| CE*3 | 0% | 0% | +0.45 | 1.00 |

*1"DASM" is the discharge amount suppressing mode.

*2"NM" is the normal mode.

*3"CE" is the comparison example.

*4"Speed" is the speed at the measurement point Z.

*5: "Ratio" is the ratio of the discharge amount of the small diameter particles in the associated mode to the discharge amount of the small diameter particles in the comparison example (ratio: 1.00).

In Table 6, the ratio of the discharge amount of the small diameter particles in each of the discharge amount suppressing mode and the normal mode when the discharge amount of the small diameter particles in the comparison example is 1 is shown. According to Table 6, the discharge amount of the small diameter particles in the discharge amount suppressing mode in this embodiment is smaller than the discharge amount of the small diameter particles in the normal mode and in the comparison example. However, compared with the cold start mode, the discharge amount of the small diameter particles was a small value in all of the discharge amount suppressing mode, the normal mode and the comparison example. In the host start mode in which the experiment is started from the warmed state of the image forming apparatus, the discharge amount of the small diameter particles becomes small without using the discharge amount suppressing mode.

Figure 6:
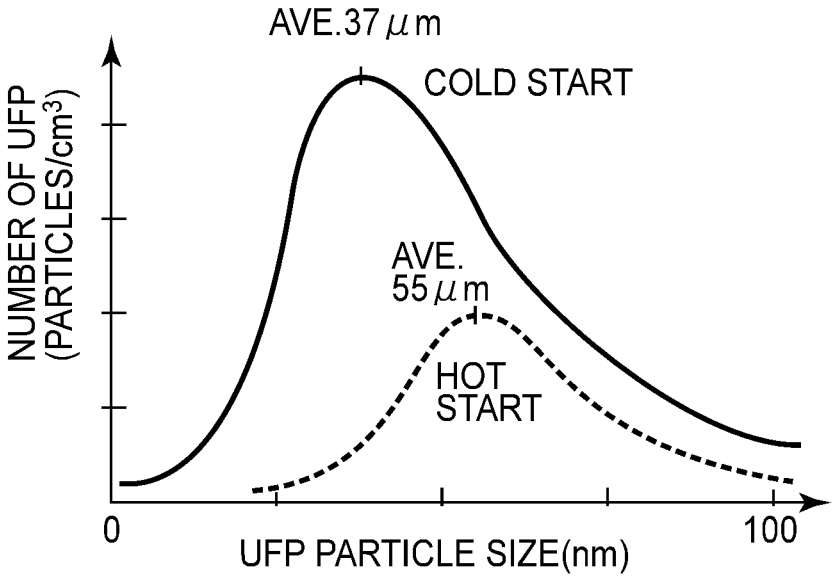
FIG. 6 is a graph showing a measurement result of a particle size distribution of small diameter particles in Second Embodiment.

A graph showing a result of comparison of a particle size distribution of the small diameter particles generated when the printing by the image forming apparatus in the operation in the normal mode in this embodiment is made in the cold start mode and in the hot start mode is shown in FIG. 6. In FIG. 6, an abscissa represents a particle size of the small diameter particles, and the ordinate represents the discharge amount per unit volume of the small diameter particles. The particle diameter distribution of the small diameter particles generated in the cold start mode is larger than that of the small diameter particles generated in the cold start mode.

In the hot start mode, the inside of the image forming apparatus is warmed, and particularly the neighborhood of the fixing device 109 and the downstream side of the fixing device 109 with respect to the recording material feeding direction are warmed by the heat generated from the fixing device 109. It would be considered that the small diameter particles generated in the fixing device 109 are bonded to each other to form the large diameter particles even when are not left in the image forming apparatus for a long time.

(Discharge Amount Suppressing Mode in Cooled State of Image Forming Apparatus)

When the image forming apparatus is operable in both the discharge amount suppressing mode and the normal mode, it would be considered that the discharge amount suppressing mode is used only in the cooled state of the image forming apparatus. That is, in the case where the image forming apparatus is in the cooled state, the small diameter particles are liable to be generated, and therefore the cooling fans are operated in the discharge amount suppressing mode. As a result, the number of the small diameter particles discharged from the image forming apparatus can be reduced. On the other hand, in the case where the image forming apparatus is in the warmed state, the small diameter particles are not readily generated, and therefore the cooling of the image forming apparatus in the normal mode is a high priority. In this way, by executing the operation in the made switched between the discharge amount suppressing mode and the normal mode depending on the state of the image forming apparatus, suppression of the discharge amount of the small diameter particles and cooling of the inside of the image forming apparatus can be compatibly realized.

An example of the operation mode switching of the cooling fans in such an air blowing unit is described. The operation mode of the cooling fans is automatically selected depending on an inside temperature of the image forming apparatus and a print continuation time from start of the printing in accordance with a condition shown in Table 7 below. That is, in the case where the inside temperature of the image forming apparatus is a predetermined temperature (e.g., 50° C.) or less and the print continuation time from the start of printing on the recording material is small (e.g., within 10 minutes from the start of printing), the air blowing unit is automatically operated in the second air blowing mode.

Incidentally, the detection temperature of the main thermistor 500 or the sub-thermistor 501 at the time of the start of printing may also be used as the inside temperature.

TABLE 7

| Inside Temperature | Elapsed time from print start: Within 10 min. | After 10 min. |
|---|---|---|
| 50° C. or less | DASM*1 | NM*2 |
| More than 50° C. | NM*1 | NM*2 |

*1"DASM" is the discharge amount suppressing mode.
*2"NM" is the normal mode.

As described above, the image forming apparatus in this embodiment is capable of executing the operation in the normal mode and the operation in the discharge amount suppressing mode, and by executing the operation in the cooling fan operation mode in a switching manner depending on the state of the image forming apparatus, it is possible to compatibly realize the suppression of the discharge amount of the small diameter particles from the image forming apparatus and the cooling of the inside of the image forming apparatus. In the operation in the discharge amount suppressing mode, the airflow directed from the fixing device toward the downstream side with respect to the recording material feeding direction is decreased in amount, so that the discharge of the small diameter particles, generated in the fixing device, to the outside of the image forming apparatus immediately after the generation is suppressed. Further, the small diameter particles are left for a long time in the neighborhood of the fixing device in the warmed image forming apparatus, so that the small diameter particles are easily bonded to each other and are deposited inside the image forming apparatus, and thus the discharge amount of the small diameter particles to the outside of the image forming apparatus can be reduced.

Incidentally, the operation mode of the cooling fans may also be selectively used depending on only the inside temperature of the image forming apparatus at the time of the start of printing or on only the print continuation time from the time of the start of printing.

Second Embodiment

An image forming apparatus in this embodiment is similar to the image forming apparatus in First Embodiment, and arrangement of cooling fans and flow paths (air paths) are similar to those in First Embodiment. In an air blowing unit in this embodiment, a controller for the cooling fans is simplified, so that each of the cooling fans 14A and 14B is only ON/OFF controlled independently, but is not controlled with respect to the number of rotation thereof and the airflow rate. Further, the air blowing unit in this embodiment is, similar as in First Embodiment, operable in the two cooling fan operation modes consisting of the normal mode and the discharge amount suppressing mode. The operation of each of the cooling fans 14A and 14B in each of the cooling modes and the air speed at the measurement point Z downstream of the fixing device 109 with respect to the recording material feeding direction are shown in Table 8.

TABLE 8

| | Output (14A) | Output (14B) | Speed (m/s)*3 |
|---|---|---|---|
| DASM*1 | OFF | ON | −0.08 |
| NM*2 | ON | ON | +0.35 |

*1"DASM" is the discharge amount suppressing mode.
*2"NM" is the normal mode.
*3"Speed" is the air speed at the measurement point Z.

During the operation in the discharge amount suppressing mode, a driving circuit for the cooling fan 14A is turned off, and a driving circuit for the cooling fan 14B is turned on, so that only the cooling fan 14B is operated. On the other hand, during the operation in the normal mode, both the driving circuits for the cooling fans 14A and 14B are turned on, so that both the cooling fans 14A and 14B are operated.

In the discharge amount suppressing mode in this embodiment, the speed of the airflow directed from the fixing device 109 toward the outside of the image forming apparatus can be made lower than the airflow speed in the normal mode. In this way, also in the image forming apparatus in this embodiment, by executing the operation in the cooling fan operation mode in a switching manner depending on the state of the image forming apparatus, it is possible to reduce the discharge amount of the small diameter particles from the image forming apparatus.

Third Embodiment

An image forming apparatus in this embodiment is the same as the image forming apparatus in First Embodiment except that a cooling fan having an output higher than the cooling fan 14B is used as the cooling fan 14B. That is, the cooling fan 14B is a DC fan motor of 92 mm×92 mm in dimension, 25 mm in depth, 1.16 ($m^3$/min) in maximum airflow rate and 24.0 (Pa) in maximum static pressure. Also the image forming apparatus in this embodiment is capable of executing the two cooling fan operation modes consisting of the normal mode and the discharge amount suppressing mode. The operation of each of the cooling fans 14A and 14B during execution of each of the cooling modes and the air speed at the measurement point Z downstream of the fixing device 109 with respect to the recording material feeding direction are shown in Table 9.

TABLE 9

| | Output (14A) | Output (14B) | Speed (m/s)*3 |
|---|---|---|---|
| DASM*1 | 100% | 100% | −0.08 |
| NM*2 | 100% | 50% | +0.33 |

*1"DASM" is the discharge amount suppressing mode.
*2"NM" is the normal mode.
*3"Speed" is the air speed at the measurement point Z.

In this embodiment, during execution of the normal mode, the output of the cooling fan 14B is 50% of the maximum output. This is because the cooling fan 14B has sufficient cooling power even when is operated at the output of 50% and is capable of reducing noise generated when is operated at the maximum output in the normal mode. Also in the discharge amount suppressing mode in this embodiment, compared with the normal mode, the speed of the airflow from the fixing device 109 toward the outside of the image forming apparatus can be made low.

In the discharge amount suppressing mode in this embodiment, both the cooling fans 14A and 14B are operated at the maximum output. In the discharge amount suppressing mode in this embodiment, it is possible to sufficiently cool the inside of the image forming apparatus while suppressing the discharge amount of the small diameter particles. Further, under the condition in which the small diameter particles are not readily generated, by executing the normal mode in which the output of the cooling fan 14B is made half of the output in the discharge amount suppressing mode, the noise due to the drive of the cooling fan can be made smaller than that in the discharge amount suppressing mode. In this way, also in the image forming apparatus in this embodiment, by executing the operation in the cooling fan operation mode in a switching manner depending on the state of the image forming apparatus, it is possible to compatibly realize suppression of the discharge amount of the small diameter particles from the image forming apparatus and a lowering in noise of the image forming apparatus.

Fourth Embodiment

An image forming apparatus in this embodiment is the same as the image forming apparatus in First Embodiment except that a reversely rotatable cooling fan is used as the cooling fan 14A. That is, the cooling fan 14A in this embodiment is a three-phase drive type DC fan motor of 80 mm×80 mm in dimension, 15 mm in depth, 0.58 ($m^3$/min) in maximum airflow rate and 22.6 (Pa) in maximum static pressure.

The cooling fan 14A is mounted so that the cooling fan 14A sends the air into the image forming apparatus when is normally rotated and so that the airflow direction is a suction direction (in which the air blowing direction from the air blowing means is reversely directed) when is reversely rotated. Incidentally, the cooling fan 14B can only be rotated normally and is mounted so that the cooling fan 14B sends the air into the image forming apparatus. Also the image forming apparatus in this embodiment is capable of executing the two cooling fan operation modes consisting of the normal mode and the discharge amount suppressing mode. The operation of each of the cooling fans 14A and 14B during execution of each of the cooling modes and the air speed at the measurement point Z downstream of the fixing device 109 with respect to the recording material feeding direction are shown in Table 10.

TABLE 10

| | Output (14A) | Output (14B) | Speed (m/s)*3 |
|---|---|---|---|
| DASM*1 | 100% (R)*4 | 100% (N)*4 | −0.18 |
| NM*2 | 100% (N)*4 | 100% (N)*4 | +0.35 |

*1"DASM" is the discharge amount suppressing mode.
*2"NM" is the normal mode.
*3"Speed" is the air speed at the measurement point Z.
*4"(R)" is the reverse rotation, and "(N)" is the normal rotation.

During execution of the normal mode in this embodiment, both the cooling fans 14A and 14B are normally rotated and are operated at the maximum output. This normal mode executes in the case where the cooling of the inside of the image forming apparatus is the high priority. On the other hand, in the discharge amount suppressing mode, the cooling fan 14A is reversely rotated, so that the cooling fan 14A is operated in a direction in which the air inside the image forming apparatus is sucked to be discharged to the outside of the image forming apparatus.

In this way, the discharge amount suppressing mode in this embodiment is capable of making the speed of the airflow, directed from the fixing device 109 toward the outside of the image forming apparatus, lower than the airflow speed in the normal mode. That is, in this discharge amount suppressing mode, although a cooling efficiency is lower than that in the normal mode, it is possible to suppress the discharge amount of the small diameter particles discharged to the outside of the image forming apparatus while cooling the inside of the image forming apparatus. Incidentally, under a condition in which the small diameter particles are not readily generated, the normal mode is executed, so that a degree of the temperature rise of the image forming apparatus can be suppressed to a low level.

In this way, also the image forming apparatus in this embodiment, by executing the operation in the cooling fan operation mode in a switching manner depending on the state of the image forming apparatus, it is possible to reduce the discharge amount of the small diameter particles from the image forming apparatus.

Modified Embodiment 1

In First to Third Embodiment, the air blowing unit control mode executably by the image forming apparatus includes the two modes consisting of the first and second air blowing modes, but the image forming apparatus may also be capable of executing three or more air blowing modes different in air speed at the measurement point Z.

Modified Embodiment 2

Further, the above-described embodiments are based on the premise that the two cooling fans (air blowing means) are used as the air blowing unit, but the number of the cooling fans may also be plural which is three or more or may also be one. For example, with respect to Tables 5, 6, 7, 8 and 10, the air blowing unit may also be constituted by a single cooling fan.

Modified Embodiment 3

Further, with respect to Table 7, the automatic selection of the first and second air blowing modes depending on the operation state of the image forming apparatus was described, but the first and second air blowing modes may also be automatically selected depending on the print number, the print ratio or the like as the operation state of the image forming apparatus. In this case, the print number, the print ratio or the like is constituted so as to be detected by a detecting means.

Incidentally, it is also possible to employ a constitution in which the first and second air blowing modes are manually selected by designation by a user.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 088172/2013 filed Apr. 19, 2013 and 072125/2014 filed Mar. 31, 2014, which are hereby incorporated by reference.

What is claimed is:

1. An image forming apparatus comprising:

an image forming portion configured to form a toner image on a recording material;

a fixing portion configured to fix the toner image on the recording material by heating the recording material while feeding the recording material, through a nip, on which the toner image is formed;

a first fan configured to take outside air into the inside of said image forming apparatus, the first fan generating airflow in a recording material feeding direction at a position downstream of the fixing portion with respect to the recording material feeding direction when only the first fan is driven;

a second fan configured to take in outside air into the inside of said image forming apparatus, the second fan generating airflow in an opposite direction to the recording material feeding direction at the position when only the second fan is driven;

a power source portion; and a controller configured to independently control the number of rotations of said first fan and said second fan, wherein the first fan is configured to blow air to the power source portion, and the second fan is configured to blow air to the image forming portion, and wherein said image forming apparatus executes an operation in a first air blowing mode in which both said first fan and second fan are driven, and executes an operation in a second air blowing mode in which both said first fan and said second fan are driven and in which the number of rotations of said first fan is lower than that in the first air blowing mode.

2. The image forming apparatus according to claim 1, wherein said image forming apparatus executes the operation in the second air blowing mode when an elapsed time from the start of continuous printing in said image forming apparatus is shorter than a predetermined time, and executes the operation in the first air blowing mode when the elapsed time is longer than the predetermined time.

3. The image forming apparatus according to claim 1, wherein said fixing portion includes a heating member and a temperature detecting member configured to detect a temperature of said heating member, and wherein said image forming apparatus executes the operation in the second air blowing mode when a detection temperature of said temperature detecting member is lower than a predetermined temperature, and executes the operation in the first air blowing mode when the detection temperature is higher than the predetermined temperature.

4. An image forming apparatus comprising:

an image forming portion configured to form a toner image on a recording material;

a fixing portion configured to fix the toner image on the recording material by heating the recording material while feeding the recording material, through a nip, on which the toner image is formed;

a first fan configured to generate airflow in a recording material feeding direction at a position downstream of the fixing portion with respect to the recording material feeding direction when only the first fan is driven;

a second fan configured to generate airflow in an opposite direction to the recording material feeding direction at the position when only the second fan is driven;

a power source portion; and a controller configured to control independently the number of rotations of said first fan and said second fan, wherein the first fan is configured to blow air to the power source portion, and the second fan is configured to blow air to the image forming portion, and wherein said image forming apparatus executes an operation in a first air blowing mode in which both said first fan and said second fan are driven so that airflow in the recording material feeding direction is generated at the position, and executes an operation in a second air blowing mode in which said first fan is not driven and said second fan is driven so that airflow in the opposite direction to the recording material feeding direction is generated at the position.

5. The image forming apparatus according to claim 4, wherein said first fan and said second fan take in outside air into the inside of said image forming apparatus.

* * * * *